United States Patent [19]

Walker et al.

[11] 3,981,357

[45] Sept. 21, 1976

[54] MARINE RISER

[75] Inventors: James M. Walker; William T. Ilfrey; Philippe H. Schaeffer, all of Houston, Tex.

[73] Assignee: Exxon Production Research Company, Houston, Tex.

[22] Filed: Feb. 3, 1975

[21] Appl. No.: 546,490

[52] U.S. Cl. ..... 166/.5; 61/86; 175/7; 138/106; 114/.5 D

[51] Int. Cl.[2] ..... E21B 7/12

[58] Field of Search ..... 166/.5, .6; 175/5, 7; 9/8 R, 8 P; 61/46, 46.5; 138/106, 107, 111; 114/.5 D

[56] References Cited

UNITED STATES PATENTS

| | | | |
|---|---|---|---|
| 3,017,934 | 1/1962 | Rhodes et al. | 175/7 X |
| 3,354,951 | 11/1967 | Savage et al. | 166/.6 |
| 3,736,077 | 5/1973 | Dane | 166/.5 |
| 3,858,401 | 1/1975 | Watkins | 175/7 X |

*Primary Examiner*—Ernest R. Purser
*Assistant Examiner*—Richard E. Favreau

[57] ABSTRACT

An improved marine riser is described which is comprised of a plurality of conduit sections joined together end to end. Buoyancy cans for retaining a compressed gas are flexibly connected to the riser at selected locations along its length and form a fluid tight seal therewith.

3 Claims, 4 Drawing Figures

MARINE RISER

BACKGROUND OF THE INVENTION

1. Field of the Invention

The present invention is directed to an improved marine drilling riser of the type which utilizes means for providing buoyant support.

2. Description of the Prior Art

A substantial amount of exploratory drilling for deposits of crude oil and natural gas situated offshore is conducted from floating vessels. Such operations normally employ a marine riser which extends between the vessel and the subsea well. The riser is formed of a number of sections of pipe connected together end to end and serves to guide the drill string into the well and conduct drilling returns back to the vessel.

The riser must be supported to prevent its buckling due to its own weight, pressure differential caused by heavy drilling fluid, and forces acting on it as a result of waves, currents and the like. Generally, such support is provided by tensioning devices positioned on the vessel which apply an axial tensile force to the riser. Because the array of tensioning devices required for very deep water would be very cumbersome, tensioning has been supplemented with external buoyancy means affixed to the riser along the length thereof, permitting use of fewer tensioners aboard the vessel.

One method of providing external buoyancy is to affix cylindrical cans to the riser pipe. The cans are closed at the top and open at the bottom, allowing compressed air to be introduced into each can to expel the water therefrom and transform it into a buoyant member. The upper ends of the cans are rigidly affixed to the riser to support the can.

Failure from overstressing or metal fatigue is a severe problem in marine risers. Stress-inducing forces are exerted on the riser by heavy drilling fluid as well as by wind, waves and currents. Buoyancy can failures experienced with drilling risers employing buoyancy cans have led to the discovery that such cans have compounded the riser stress problem by substantially increasing stress in the riser.

SUMMARY OF THE INVENTION

The present invention relates to an improved marine drilling riser of the type which utilizes external means for providing buoyant support and alleviates the problems outlined above. In accordance with the invention, a marine riser is provided which includes a plurality of pipe sections connected together in end to end relation and extending between a subsea well and a drilling vessel situated at the water surface. A plurality of buoyancy cans are positioned concentrically about the riser and are situated at selected locations spaced along the length thereof. The cans are open at the bottom and are sealably connected to the riser at their upper end by a means for substantially eliminating the transfer of bending moments between the can and the riser.

In a preferred embodiment of the invention, a can is mounted over each of a plurality of selected riser pipe sections for receiving and retaining air or other compressed gas in the annular space between the riser pipe and the wall of the can. A connector is mounted on the upper end of the can for attaching the can to the riser at the connection between two riser joints. The connector includes means for flexibly attaching the can to the riser so as to form a seal therewith. A radial restraint guide is affixed to the riser pipe inwardly of the wall of the can to prevent excessive lateral movement of the can with respect to the riser pipe.

The riser of the present invention has the advantage of reducing the stiffness a riser provided with rigidly connected buoyancy cans would otherwise have and of eliminating localized stress concentrations at the point where each can is affixed to the riser. The riser of the present invention therefore has significant advantages over systems existing heretofore.

DESCRIPTION OF THE PREFERRED EMBODIMENT

Figure 3:
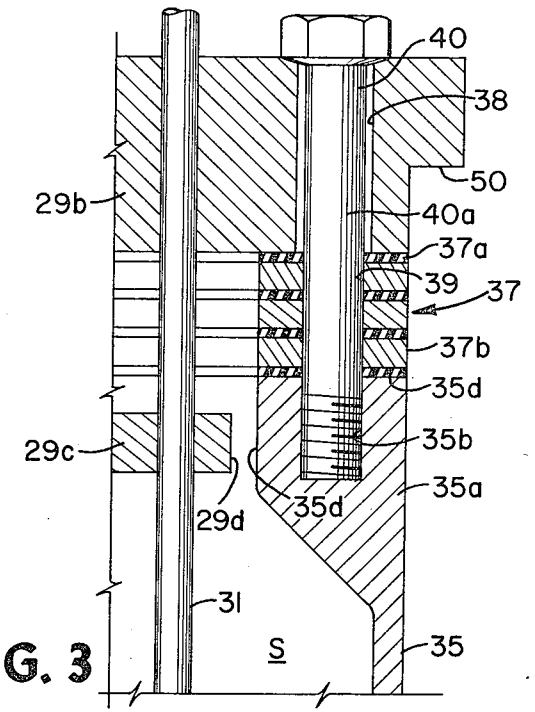
FIG. 3 is a sectional view of the flexible connection of the buoyancy can to the riser joint.
Figure 4:
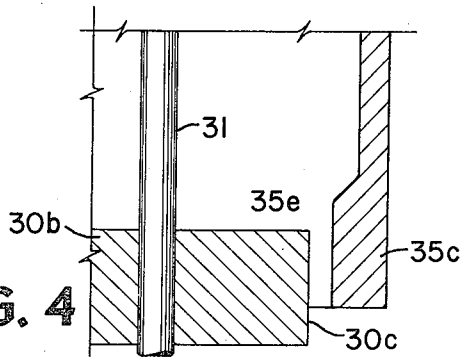
FIG. 4 is a sectional view of the lower end of the buoyant can depicting the lower lateral restraint guide.

Referring to the drawings, the letter R generally designates the riser system of the preferred embodiment of this invention with its flexibly connected buoyancy cans. The riser extends from a floating drilling vessel V downwardly to subsea well W located on the bottom 10 of a body of water 11. The vessel includes a derrick D for supporting the drill string 13, which extends downwardly through an opening 12 extending through the vessel. The riser column guides the drill string into the subsea well and provides a conduit for the drilling fluid to return to the vessel.

The upper end portion 14*a* of the riser is connected to a slip joint assembly 15. The slip joint assembly 15 is connected by cables 15*a* to the vessel and compensates for relative vertical movement between the vessel and riser. Tensioning devices, designated by numerals 16 and 17, are positioned on the vessel and are attached to a clamp 18 affixed to the lower barrel of slip joint 15. Tensioners 16 and 17 function to exert a vertical tensile load on the riser. At its lower end 14*b*, the riser is pivotally connected to a blowout preventer stack 20 by means of a ball joint designated by the number 19. The blowout preventer stack is in turn connected to wellhead 21 at the bottom of the body of water.

The riser is comprised of a plurality of riser sections 25 connected end to end. One of the plurality of sections 25 of riser pipe having a buoyancy can 35 attached to it is illustrated in detail in FIG. 2. The illustrated riser section includes a cylindrical conduit or pipe which has affixed to the ends thereof an upper riser connector 29 and a lower riser connector 30. Pipe section 25 is a hollow, cylindrical member having an inside diameter sufficiently large to allow the passage of the drill string 13 including a drill bit mounted on the lower end thereof.

Upper riser connector 29 includes a hub portion 29*a* which is welded or otherwise connected to the upper end of pipe section 25. A flange portion 29*b* extends radially outwardly from the hub and forms an integral part thereof. It will be appreciated, however, that it could also be welded or otherwise attached to hub 29*a*.

The lower riser connector 30 also includes a corresponding hub portion 30*a* and flange portion 30*b*.

Figure 2:
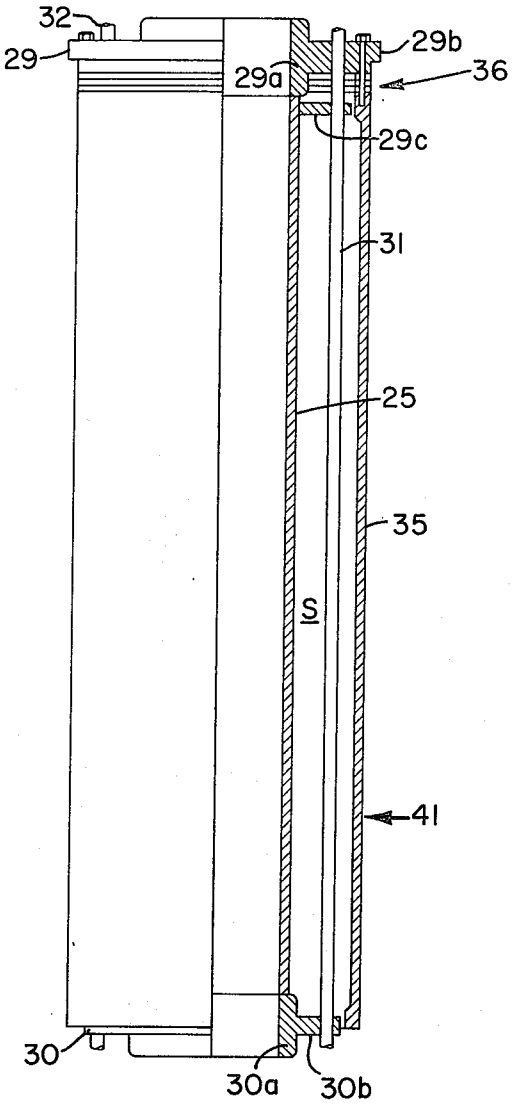
FIG. 2 is a side view partly in section of a section of riser pipe having a buoyancy can affixed thereto in accordance with the preferred embodiment of this invention.
Figure 1:
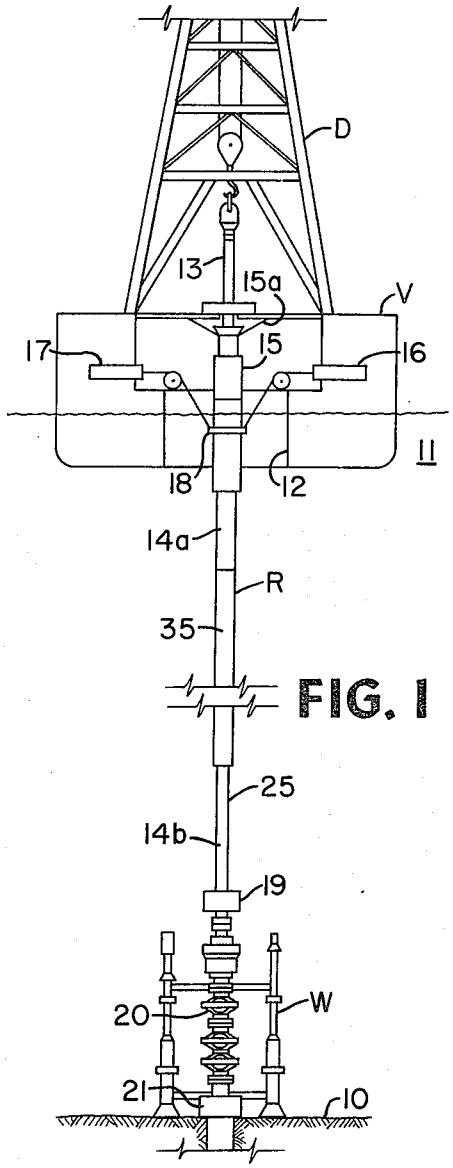
FIG. 1 is a schematic elevation of the riser system of the present invention extending between a floating drilling vessel and a subsea well.

Conduits 31 and 32, FIG. 2, extend through flange portions 29*b* and 30*b* of the upper and lower riser pipe connectors and along the length of riser pipe section 25. Conduits 31 and 32 are aligned in parallel with the longitudinal axis of riser section and are sealed about their periphery where they extend through the upper riser connector flange portion 29*b*. Such sealable connection may be provided by any suitable means. The conduits may be utilized to conduct various fluids, for example, as a source of compressed air to displace water from the buoyancy cans. In addition, they may be utilized to convey hydraulic fluid to power hydraulic valve elements or operators located at the subsea well or as choke and kill lines for controlling surges in well pressure.

A cylindrical can 35 is positioned concentrically about riser pipe section 25. Connector means, designated generally as 36 (FIG. 3), interconnect buoyancy can 35 and upper riser connector 29 for sealing the upper end of buoyancy can 35 against loss of fluid and for limiting the transfer of bending moments between the buoyancy can and the riser pipe 25. Buoyancy can 35 is normally a hollow cylindrical member and is generally made of metal. It is to be noted, however, that other shapes of buoyancy cans could also be employed. For example, the can may be swagged and have more than one diameter. The internal diameter of the can 35 is sized to provide an annular space S between the riser section 25 and the wall of the buoyancy can to provide the desired amount of buoyancy. The connector means 36 provides an essentially moment free, sealed connection between upper riser connector 29, and in particular the flanged portion 29*b* thereof, and buoyancy can 35 so that compressed air or other buoyancy inducing fluid can be received and retained within annular space S. Since the air or other compressed gas is not introduced into the buoyancy cans until they are submerged, the pressure of the fluid piped into the annular space must be sufficient to overcome the hydrostatic head of the water at the particular depth of each buoyancy can 35.

Connector means 36 includes an annular, flexible gasket mounted on the top rim 35*d* of buoyancy can 35. Preferably, as shown in FIG. 3, a laminated gasket 37 is employed which includes alternate layers 37*a* of rubber or other suitable resilient, sealing material positioned between annular rings 37*b* of steel or other rigid material. The alternate layers of rubber or other flexible sealing material provide a sealed connection between flange portion 29*b* of the upper riser connector and top rim 35*d* of the buoyancy can. In addition, the layers of flexible material permit movement of the cylindrical can with respect to riser pipe section 25. In this manner, connector means substantially eliminate the transfer of bending moments between the riser and the buoyancy can. This in turn serves to reduce the stress level in the riser pipe and thus increase its service life.

The upper end 35*a* of the buoyancy can 35 includes a series of circumferentially spaced, threaded bolt holes 35*b* extending therein. Flange 29*b* of the upper riser connector and the annular gasket 37 include a group of circumferentially spaced openings 38 and 39 that align with the threaded holes 35*b* in the upper end 35*a* of the buoyancy can. Apertures 38, 39 and 35*b* are adapted to receive connector bolts 40 which extend through the openings 38 and 39 into threaded engagement with the opening 35*b*. The diameter of the opening 38 through the flange is larger than that of the bolt to allow for limited movement of the bolt shaft in response to movement of buoyancy can 35. Thus, limited movement of the buoyancy can 35 can be tolerated without imposing significant bending stresses on the bolt shaft, thereby increasing the life of bolts 40.

The annular, elastic connecting gasket 37 substantially prevents the transfer of bending moments between the riser and the buoyancy can 35 by permitting limited pivotal movement or flexure of the cylindrical can 35 with respect to the upper riser connector flange 29*b*. For example, in response to a force applied in the direction of arrow 41 to the right-hand side of can 35, the buoyancy can 35 will tilt in the direction 41 of the force. The annular, resilient gasket 37 is thus compressed on the left-hand side thereof, permitting the flexing of the buoyancy can. The compression of the resilient gasket 37 prevents the transfer of any substantial bending moment to the riser.

Situated just below upper riser connector 29 is a radially extending, lateral restraint guide 29*c*. It may be welded or otherwise attached to hub portion 29*a* of the upper riser connector or be directly connected to the riser pipe. The lateral restraining guide 29*c* provides an outer restraining surface 29*d* which is positioned a predetermined distance away from an inner surface 35*d* of the upper end of the buoyancy can. The distance between inner surface 35*d* of the can and the outer surface of the lateral restraint guide 29*c* is sufficient to allow only limited lateral movement of the buoyancy can, thereby protecting the integrity of the annular gasket 37 and preventing failure of connector bolt 40. Similarly, flange portion 30*b* of the lower riser connector 30 includes an outer, restraining surface 30*c* which is positioned a predesignated distance away from the inner surface 35*e* of the buoyancy can in order to limit lateral movement of the lower end of the buoyancy can.

The upper riser connector 29 further includes a downwardly facing, annular shoulder or offset 50 which is adapted to receive a spider or other gripping device for supporting the entire riser.

The foregoing disclosure and description of the invention are illustrative and explanatory thereof, and various changes in the size, shape and materials as well as in the details of the illustrated construction may be made without departing from the spirit of the invention.

We claim:

1. Apparatus for drilling a subsea well from a floating vessel comprising:

a. a plurality of conduit sections joined in end to end relation to form a marine riser extending between the vessel and the subsea well;

b. a plurality of buoyancy cans disposed in concentric relation about said riser at selected locations along the length thereof, the lower end of each can being open and free to move laterally; and c. a laminated gasket positioned between said riser and said can, said gasket having alternate layers of metal and resilient, sealing material, said gasket being operative to freely allow the lower end of each can to move laterally to substantially eliminate the transfer of bending moments between said can and said riser upon bending movement of said riser.

2. Apparatus for drilling a subsea well from a floating vessel comprising:

a. a plurality of conduit sections joined in end to end relation to form a marine riser extending between the vessel and the subsea well;

b. a plurality of buoyancy cans disposed in concentric relation about said riser at selected locations along the length thereof, the lower end of each can being open and free to move laterally;

c. flexible connecting means for sealably connecting the upper end of each can to said riser, said flexible connecting means being operative to freely allow the lower end of each can to move laterally to substantially eliminate the transfer of bending moments between said can and said riser upon bending movement of said riser; and d. upper and lower radial restraint guides affixed to said riser inwardly of said can to prevent excessive movement of said can with respect to said riser.

3. Apparatus for buoyantly supporting a section of conduit comprising:

a. a buoyancy can mounted concentrically about said conduit and being sized to form an annular space therebetween; and b. a laminated gasket having alternate layers of a metal and a resilient material, said gasket connecting said can to said conduit, said gasket being operative to permit free movement of the non-attached lower end of said can with respect to said conduit to substantially eliminate the transfer of bending moments between said can and said conduit upon bending movement of said conduit.

* * * * *